United States Patent [19]

Bianco

[11] Patent Number: 4,811,870

[45] Date of Patent: Mar. 14, 1989

[54] LIQUID CONTAINER WITH ROTATABLE SPOUT

[75] Inventor: Andrew S. Bianco, Lima, Ohio

[73] Assignee: The Dyson-Kissner-Moran Corporation, New York, N.Y.

[21] Appl. No.: 594,966

[22] Filed: Mar. 29, 1984

[51] Int. Cl.[4] ..... B67D 3/00

[52] U.S. Cl. ..... 222/461; 222/468; 222/475; 222/482; 222/533; 222/536; 222/537; 222/538; 222/566; 222/570

[58] Field of Search ..... 222/533, 538, 460, 461, 222/482, 526, 536, 537, 570, 567, 566, 465 R, 468, 530, 553, 556, 475; 220/85 SP

[56] References Cited

U.S. PATENT DOCUMENTS

| | | | |
|---|---|---|---|
| 539,460 | 5/1895 | Webster . | |
| 877,435 | 1/1908 | Keeran . | |
| 950,372 | 2/1910 | Deitz | 222/536 X |
| 1,337,558 | 4/1920 | King . | |
| 1,959,961 | 5/1934 | Neil | 222/536 X |
| 1,993,255 | 3/1935 | Baggett et al. | 222/536 X |
| 2,580,811 | 1/1952 | Martinsen | 222/460 |
| 2,673,664 | 3/1954 | Boysen | 222/469 |
| 2,816,695 | 12/1957 | Dagenais | 222/481 |
| 3,159,320 | 12/1964 | Scholtz | 222/482 X |
| 3,490,501 | 1/1970 | Manem et al. | 141/84 |
| 3,708,092 | 1/1973 | Frazer | 222/567 |
| 3,746,200 | 7/1973 | Flider | 215/10 |
| 3,987,943 | 10/1976 | Richmond, Jr. | 222/570 |
| 4,125,207 | 11/1978 | Ernst et al. | 222/130 |
| 4,231,497 | 11/1980 | Bourbon | 222/527 |

FOREIGN PATENT DOCUMENTS

| | | | |
|---|---|---|---|
| 1263585 | 3/1968 | Fed. Rep. of Germany | 222/533 |
| 2332014 | 1/1975 | Fed. Rep. of Germany | 222/533 |
| 690841 | 4/1953 | United Kingdom | 222/567 |

*Primary Examiner*—Kevin P. Shaver
*Assistant Examiner*—David H. Bollinger
*Attorney, Agent, or Firm*—Biebel, French & Nauman

[57] ABSTRACT

A low profile, liquid container, preferably of molded plastic construction, has rotatably mounted on it a dispensing spout which can be rotated between a pouring position and a stowed position overlying a carrying handle for the container. The rotatable spout is provided with outwardly projecting ribs which are alternately engageable with projections formed on the container to lock the spout in either the pouring or the stowed positions.

1 Claim, 3 Drawing Sheets

LIQUID CONTAINER WITH ROTATABLE SPOUT

BACKGROUND OF THE INVENTION

The present invention relates generally to portable liquid storage containers and, more particularly, to a stable, low profile liquid container having a rotatable spout.

Portable containers for storing liquids such as gasoline, kerosene, water or the like are usually provided with upwardly extending spouts which are closed by an internally threaded cap screwed onto complementary external threads formed on the spout. Typically, container spouts are short to facilitate handling and storage of the containers; however, short spouts can be inconvenient when pouring liquid from the container into fuel tanks of equipment, such as kerosene heaters, automobiles, lawn mowers and the like. When liquid is poured from such storage containers, there is often spillage, resulting in irritating fumes and potentially hazardous situations, since the stored liquid may be highly flammable.

The spouts commonly provided on such containers are usually of a relatively large diameter to facilitate closure thereof. This increases the likelihood of spillage where the opening into which the liquid is poured is of relatively small diameter, as with gasoline powered lawn mowers, snow blowers, kerosene heaters, or the like.

A variety of solutions are proposed by the prior art to overcome these problems. For example, a conventional conical funnel may be used. Conventional funnels, however, have obvious disadvantages, since they frequently cannot be conveniently supported or manually held in place during pouring. For example, the fill opening of a lawn mower or the gasoline tank of an automobile may present obstacles which prevent a conventional funnel from being supported or even from engaging the opening of the tank. Also, conventional funnels are separate from the storage container and, hence, are often misplaced and unavailable when needed.

To overcome the disadvantages of conventional funnels, a number of prior art funnels are attached to the container for storage and/or dispensing the liquids. Examples of such apparatus are disclosed in U.S. Pat. Nos. 877,435; 2,580,811; and 3,987,943.

An alternate solution to the problem has been to include an open funnel more resembling a trough down which liquid can be poured from a storage container. Such "funnels" or troughs typically are secured in one position for pouring liquid from the container and then removed and resecured or pivoted to a second position for storing the funnel or trough with the container. Such arrangements are disclosed in U.S. Pat. Nos. 3,708,092 and 4,231,497.

Still another prior art solution is disclosed in U.S Pat. No. 2,673,664 wherein a combination handle/funnel is hingedly mounted to a container. The disclosed handle/funnel seals the opening of the container when closed into a handle forming position and opens the container to serve as a funnel when swung out from the container by means of the hinged mounting to dispense liquid from the container.

Finally, a variety of pivotally mounted, fully enclosed spouts are known in the prior art. Such spouts often combine a dispensing function through the enclosed spouts as well as a container sealing or closing arrangement by means of the pivotal attachment of the spout. Examples of a variety of pivoting enclosed spouts are disclosed in U.S. Pat. Nos. 539,460; 2,816,695; and 4,125,207.

While these prior art devices alleviate some of the problems associated with dispensing liquids from conventional storage containers, there are still difficulties associated with each.

For example, the detachable spouts suffer from many of the same problems described above for a conventional funnel. The open funnel or trough arrangements tend to be sloppy and lead to spills if not carefully used. The hingedly mounted combination handle and funnel arrangement requires substantial strength to be used for supporting a container of any size. Finally, the various enclosed spout arrangements, while they prevent substantial spillage during pouring, do not permit direct visual observation by a user of the container. Furthermore, the known enclosed spout arrangements require multiple parts and, hence, tend to be expensive.

It is, therefore, apparent that a need exists for a liquid storage container which includes a convenient liquid dispensing arrangement, is inexpensive to manufacture, and overcomes the many difficulties noted of the prior art.

SUMMARY OF THE INVENTION

In accordance with the present invention, a stable, low profile liquid container is provided having an integrally formed, upwardly projecting neck, to which is attached a dispensing spout rotatable between stowed and pouring positions, with the dispensing spout comprising a funnel portion for receiving liquid from the container and a nozzle portion for receiving liquid from the funnel portion and directing and dispensing it through the spout outlet. The container neck is generally cylindrical and projects upwardly from a planar upper surface of the container, and the neck has a base portion which includes an annular flange formed about its periphery a defined distance above and parallel to the planar upper surface of the container. A container handle is formed integrally with and projects upwardly from the upper surface of the container, with the handle being disposed rearwardly of the neck of the container and extending longitudinally thereof.

The dispensing spout has a generally cylindrical collar, sized and adapted to be mounted onto the base of the container neck between the annular flange and the container upper surface, such that the collar and spout can be rotated between stowed and pouring positions, while being retained by the annular flange. The funnel portion of the spout is connected to the collar and tapers from the collar to a generally cylindrical entrance to the nozzle portion such that the funnel conforms to an angled end portion of the handle when pivoted over the handle.

The nozzle portion of the spout lies parallel and in close proximity to a generally horizontal bridging portion of the handle and includes a downwardly extending end portion, such that the spout conforms to the shape of the handle and also provides a conveniently downturned end to facilitate insertion into a small filler opening of a fuel tank.

Preferably, the collar of the spout includes at least two diametrically positioned, outwardly projecting ribs alternately engageable with a pair of spaced projections formed intermediate the container neck and handle and on an opposite side of the neck, respectively, to lock the spout in either the stowed or pouring position.

Preferably, the handle of the container expands into a chamber at an end of the handle opposite the container neck. The chamber is in communication with the interior of the container, extends above the upper surface thereof and includes a vent, which can be selectively opened and closed for venting the container during pouring.

Preferably, a portion of the container neck extends above the annular rib and is angularly oriented to facilitate pouring liquid from the container into the wide entrance opening of the funnel portion of the dispensing spout. The angular orientation of the upper extension of the container neck is at an angle of approximately 30° from the vertical and the downwardly sloping portions of the handle are oriented at an angle of approximately 45° from the horizontal in a preferred embodiment. The container in accordance with the present invention can be conveniently formed as an integral member of plastic by a molding process, which allows it to be molded to a rectangular shape of a low profile to provide stability against inadvertent tipping.

It is, therefore, an object of the present invention to provide improved liquid storage and dispensing apparatus wherein a combination funnel and nozzle are coupled for rotation about an upwardly projecting neck of a low profile, liquid container.

Other objects and advantages of the invention will be apparent from the following description, the accompanying drawings and the appended claims.

DETAILED DESCRIPTION OF THE INVENTION

Figure 1:
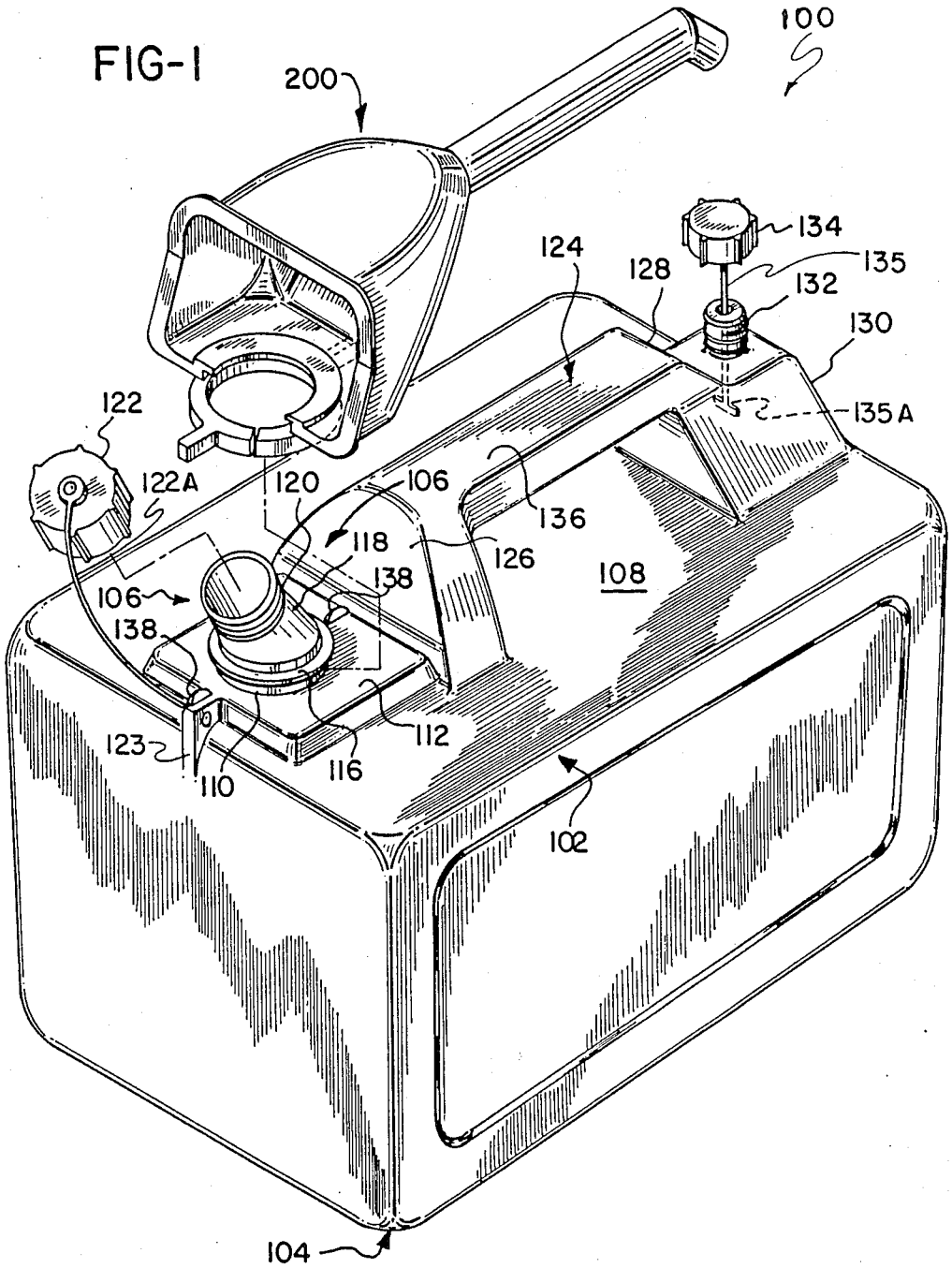
FIG. 1 is an exploded perspective view of a liquid container with a rotatable spout in accordance with the present invention.
Figure 2:
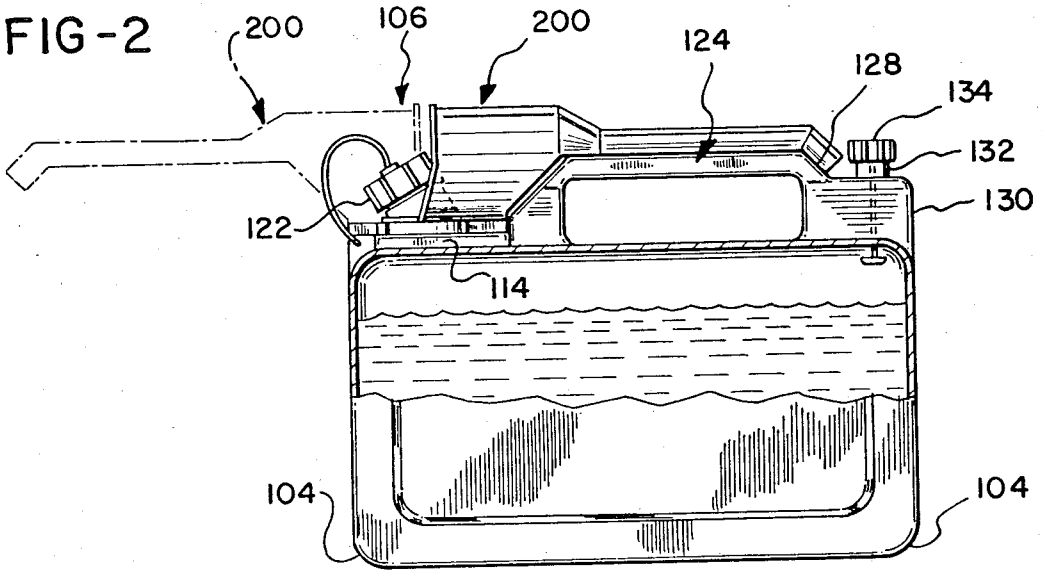
FIG. 2 is a side view, showing the stable, low profile of the container of the present invention.
Figure 3:
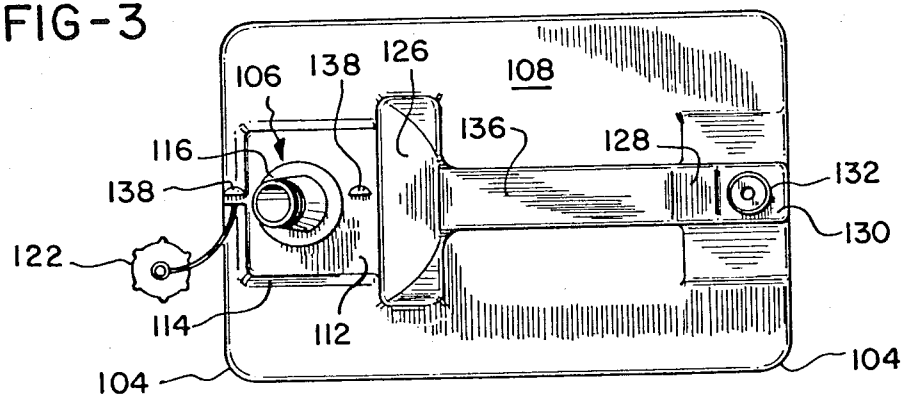
FIG. 3 is a plan view of the container of the present invention.
Figure 4:
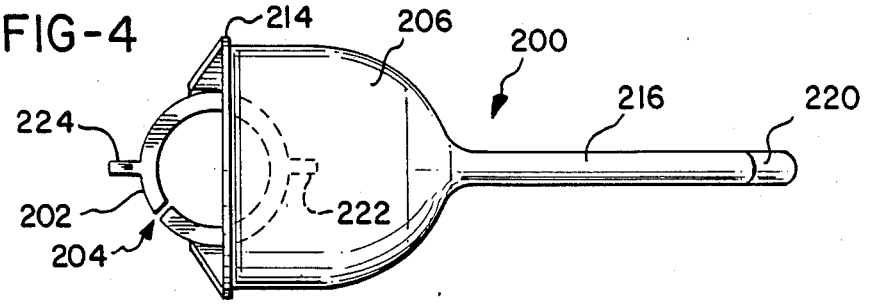
FIG. 4 is a top view of the dispensing spout taken along line 4—4 of FIG. 5.
Figure 5:
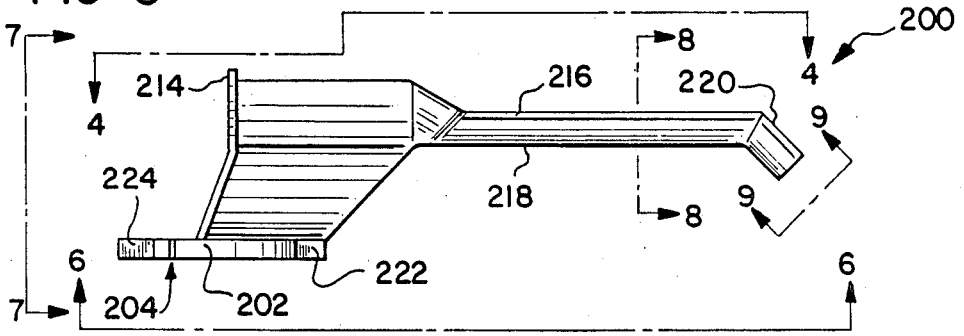
FIG. 5 is a side elevational view of the dispensing spout.
Figure 6:
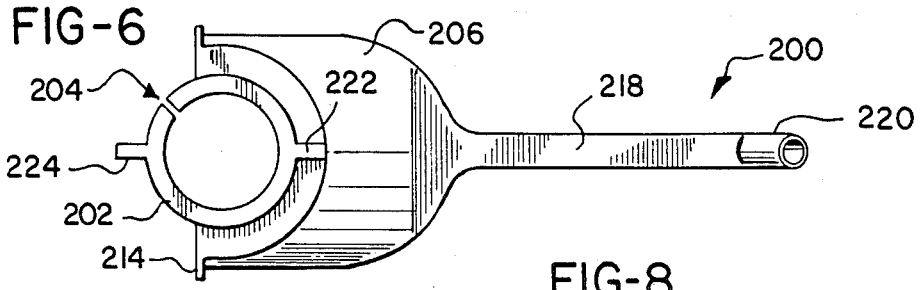
FIG. 6 is a bottom view taken along line 6—6 of FIG. 5.

The container and spout of the present invention, indicated by the reference numeral 100, are shown in exploded perspective view in FIG. 1, and as can best be appreciated from an inspection of FIGS. 1-3 of the drawings, container 102 has a stable, low profile and can be of molded plastic construction. As best seen in FIGS. 2 and 3, the container has generally rectangular top, bottom, front, back and side walls and rounded safety corners 104. A container neck 106 projects above a generally planar upper surface 108 of the container 102.

The container neck 106 includes a cylindrical base portion 110 which extends a predefined distance above the upper surface 112 of a platform 114. At its upper end the cylindrical base 110 has an annular flange 116 which projects outwardly from the base upper end. The remainder of the neck 106 includes an angularly oriented extension 118 which extends preferably at an angle of approximately 30° from the vertical above the flange 116 of the base 110. The extension 118 terminates in a threaded portion 120 which receives an internally threaded cap 122. A cap retaining strap 122A secures the cap 122 to an ear 123 on the container 102, such that the cap cannot be inadvertently misplaced when removed.

An integrally formed handle 124 extends upwardly from the upper surface 108 of the container 102, and, as best seen in FIG. 2, is spaced from and extends along the upper surface 108 of the container. The end of the handle 124 adjacent the neck 106 comprises a sloping portion 126 which expands laterally across the container 102, while the opposite end 128 of the handle 124 slopes downwardly away from the neck 106.

The end portion 128 expands into a chamber 130 which is in communication with the interior of the container 102 and includes a threaded vent spout 132 which is selectively closed or opened by a cap 134 to vent the interior of the container 102 when liquid is dispensed therefrom. The vent cap 134 is secured to the container 102 by a retaining strap 135 which includes a T-shaped end section 135A. The downwardly sloping end portions 126 and 128 of the handle 124 are interconnected by a generally horizontal bridge portion 136 which is grasped to transport the container 102.

A first raised projection 138 is formed between the container neck 106 and the container handle 124 and a second projection 138 is formed on the ear 123 for a purpose to be presently described.

A spout 200, also preferably of molded plastic construction, is mounted on the cylindrical base 110 of the container neck 106 for rotation thereabout. The spout 200 comprises a collar 202 which is sized to receive the cylindrical base 110 of the neck 106. Collar 202 is of resilient, split ring construction, as indicated at 204, so that it may be expanded over flange 116 to engage the cylindrical base 110 between the flange 116 and the upper surface 112 of platform 114.

Spout 200 further comprises a funnel portion 206 which is connected to and expands from the collar 202. The funnel 206 forms a wide entrance opening 208 adjacent to the collar 202 and then narrows to an outlet section 210 such that liquid is funneled in a direction substantially perpendicular to the axis of the collar 202. The entrance opening 208 of the funnel 206 is surrounded by an integrally formed reinforcing rib 214.

Figure 8:
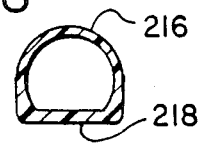
FIG. 8 is a cross-sectional view of the nozzle portion of the spout taken along line 8—8 of FIG. 5.
Figure 7:
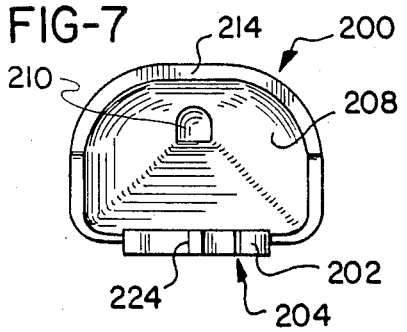
FIG. 7 is an end view taken along line 7—7 of FIG. 5.

The narrowed outlet 210 of the funnel 206 communicates with a tubular nozzle 216, which has a flattened bottom portion 218 as best seen in FIG. 8. While it is preferred that the nozzle 216 be flattened to conform to the upper surface of the bridging portion 136 of the handle 124, it is clear that it could be cylindrical or take other geometric cross-sections.

Figure 9:
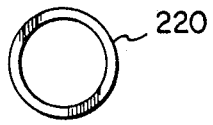
FIG. 9 is an end view of the spout outlet as viewed from line 9—9 of FIG. 5.

The nozzle 216 terminates in a downwardly extending end portion 220, which is circular in cross-section as best seen in FIG. 9. The end portion 220 of the nozzle 216 conforms to the end portion 128 of the handle 124 and also facilitates insertion of the nozzle 216 into a narrow fill opening into which liquid from the container 102 is to be poured.

The collar 202 includes a pair of diametrically positioned, outwardly projecting ribs 222 and 224, engageable with the projections 138 for positioning and securing the spout 200 in either the stowed position shown in the solid lines in FIG. 2 or the dispensing position shown in phantom lines in FIG. 2. Additional liquid dispensing positions can be defined by additional ribs radially extending from the collar 224 to variously position the spout 200.

In accordance with the present invention, the cap 122 may be removed from the threaded portion 120 of the container neck 106 such that a liquid, such as gasoline, may be introduced into the container 102. The cap 122 is then secured to the threaded portion 120 of the neck 106 and the container 102 may then be transported by grasping the handle 124. The filling operation is performed while the spout 200 is in the stowed position with the nozzle 216 extending over the bridge portion 136 of the handle 124. With the spout in the stowed position, it does not interfere with the filling operation or transportation of the container by grasping the handle 124.

When liquid is to be dispensed from the container 102, the spout 200 is rotated about the cylindrical base 110 of the neck 106 until the ribs 222 and 224 engage the projections 138. Preferably, the cap 122 is removed from the neck 106 prior to the rotation of the spout 200 from the stowed position over the handle 124.

The angular orientation of the upper extension 118 of the container neck 106 facilitates the pouring of liquid from the container 102 into the large entrance opening 208 of the funnel 206. The downwardly turned end portion 220 of the nozzle 216 facilitates engagement of the nozzle with the fill opening of a tank or other container which is to receive liquid from the container 102. Prior to pouring, of course, the cap 134 is loosened or removed to vent the interior of the container 102.

It is apparent from the foregoing description that improved liquid storage and dispensing apparatus has been disclosed which is inexpensive to manufacture, convenient for the user and overcomes many of the shortcomings of prior art liquid storage and dispensing arrangements.

While the form of apparatus herein described constitutes a preferred embodiment of this invention, it is to be understood that the invention is not limited to this precise form of apparatus and that changes may be made therein without departing from the scope of the invention which is defined in the appended claims.

What is claimed is:

1. Liquid storage and dispensing apparatus comprising:

a one-piece, molded, plastic storage container having substantially rectangular top, bottom, front, back and side walls defining a single, separate, generally cubical container having side walls substantially longer than they are high to provide a stable, low profile, substantially rectangular, raised platform projecting upwardly from said top wall adjacent one end thereof, a neck having a base portion projecting substantially perpendicularly upwardly from an upper surface of said platform and an extension projecting angularly with respect to a central axis of said base portion from an upper end thereof, an annular flange projecting outwardly from said base portion at said upper end thereof, a handle formed integrally with said container and extending from adjacent an edge of said platform longitudinally of said container, said handle having a first, relatively wide portion adjacent said platform edge which slopes upwardly, inwardly and away from said platform edge to a relatively narrow bridge portion which extends in spaced relationship to said top wall of said container and terminates at an end portion which slopes downwardly to a chamber projecting upwardly from said top wall at an end thereof opposite said one end, means defining a vent opening in said chamber, a one-piece, molded plastic spout having a collar, an upwardly open funnel portion connected to and having a wide opening adjacent said collar and tapering inwardly away from said collar to an elongated closed nozzle portion of relatively smaller cross-sectional area with an upstream end of said nozzle portion communicating with a downstream end of said funnel portion, and said collar being mounted on said base portion of said neck intermediate said flange and said upper surface of said platform, and rotatable, while continuously attached to said neck, between a stowed position overlying said handle with a lower surface of said spout in closely spaced relationship to an upper surface of said handle, and a dispensing position projecting outwardly of said container with said lower surface of said spout disposed beneath an upper surface thereof.

* * * * *